US005419262A

United States Patent [19]

Turpin, Sr.

[11] Patent Number: 5,419,262

[45] Date of Patent: May 30, 1995

[54] RAILROAD HOPPER CAR DOOR CLOSER

[76] Inventor: Robert T. Turpin, Sr., Rte. 1, Box 90, Pineville, Ky. 40977

[21] Appl. No.: 202,553

[22] Filed: Feb. 28, 1994

[51] Int. Cl.[6] ..... B61D 7/30

[52] U.S. Cl. ..... 105/241.2; 105/286; 105/289

[58] Field of Search ..... 105/241.2, 286, 288, 105/289, 296, 304, 306; 414/376, 387, 402; 16/71

[56] References Cited

U.S. PATENT DOCUMENTS

| | | | |
|---|---|---|---|
| 1,876,637 | 9/1932 | Dietrichson . | |
| 2,686,478 | 8/1954 | Harbulak | 105/286 |
| 3,227,100 | 1/1966 | Smith et al. | 105/286 |
| 3,314,558 | 4/1967 | Dorey . | |
| 3,606,043 | 9/1971 | Miller . | |
| 3,872,796 | 3/1975 | Adler et al. | 105/241 |
| 4,011,956 | 3/1977 | Green et al. | 105/241.2 X |
| 4,120,412 | 10/1978 | Miller et al. . | |
| 4,329,106 | 5/1982 | Adler | 414/388 |
| 5,299,508 | 4/1994 | Connelly | 105/286 X |

FOREIGN PATENT DOCUMENTS

| | | | |
|---|---|---|---|
| 1390103 | 4/1988 | U.S.S.R. | 105/241.2 |
| 1562196 | 5/1990 | U.S.S.R. | 105/241.2 |
| 1661021 | 7/1991 | U.S.S.R. | 105/241.2 |

*Primary Examiner*—Robert J. Oberleitner
*Assistant Examiner*—S. Joseph Morano
*Attorney, Agent, or Firm*—Jacobson, Price, Holman & Stern

[57] ABSTRACT

A closer for hopper car doors including a supporting frame structure associated with the rails on which a series of hopper cars are rollingly supported together with power actuated devices that will pivot the hopper car doors from a generally vertical, downwardly extending open position which exists after the hopper car has been unloaded for engaging the hopper car doors and pivoting them about their transversely extending supporting axis to a closed, latched position. The power devices include transversely extending support shafts with a pair of laterally extending arms rigid therewith with each arm including a wheel at the outer end thereof for engaging the hopper car doors when the transverse shafts are pivoted. The transverse shafts are pivoted by hydraulically operated piston and cylinder assemblies connected to a laterally extending arm on one end portion of each shaft with activation devices being positioned in the path of movement of the hopper cars to activate the closer when the hopper car doors are in appropriate position for engagement by the wheels for movement of the hopper car doors to a closed, latched position.

16 Claims, 3 Drawing Sheets

RAILROAD HOPPER CAR DOOR CLOSER

BACKGROUND OF THE INVENTION

1. Field of the Invention

A device for automatically closing railroad hopper car doors after the car has been unloaded through the hinged doors forming a portion of the bottom of conventional railroad hopper cars. A supporting frame structure is associated with the rails on which a series of hopper cars are rollingly supported together with power actuated devices that will pivot the hopper car doors from a generally vertical, downwardly extending position which exists after the hopper car has been unloaded for engaging the hopper car doors and pivoting them about their transversely extending supporting axis to a closed, latched position. The power devices include transversely extending support shafts with a pair of laterally extending arms rigid therewith with each arm including a roller at the outer end thereof for engaging the hopper car doors when the transverse shafts are pivoted. The transverse shafts are powered by hydraulically operated piston and cylinder assemblies connected to a laterally extending arm on one end portion of each shaft with activation devices being positioned in the path of movement of the hopper cars to activate the closer when the hopper car doors are in appropriate position for engagement by the rollers for movement of the hopper car doors to a closed, latched position.

2. Description of Related Art

It is well known that closing hopper car doors after the hopper car has been unloaded by releasing the hopper car doors and permitting them to drop to a generally vertical position about a transverse hinge axis presents substantial problems. Frequently, the method used to close most hinged hopper car doors is to pry the door toward closed position with a metal bar as a lever member until it catches on a loose fitting latch. Also, manual movement by physical grasping or by movement with the foot is sometimes used. When a metal bar is used, the person using the bar must then reposition the bar in the lock mechanism where the bar is again used as a lever to apply sufficient force to the bar to secure the door to another latch or catch which holds the door in a tight fitting position. This procedure must be followed on both sides of the hopper car in order to close both doors. Prior efforts have been to provide mechanisms oriented alongside a railroad track to engage and close hopper car doors. The following U.S. Patents relate to this subject matter.

U.S. Pat. Nos.
1,876,637
2,686,478
3,227,100
3,314,558
3,606,043
3,872,796
4,120,412
4,329,106

The previously patented devices do not disclose an automatically activated unit responsive to positioning of the hopper car in relation to the closer and do not disclose a straddle arrangement in which multiple hopper car doors are simultaneously closed by engaging the outer or bottom surface of the hopper car doors and pivoting them about a transverse axis at their upper edges and swinging them into a closed position for engagement with a tight fitting catch or latch.

SUMMARY OF THE INVENTION

An object of the present invention is to provide a hopper car door closer incorporating door engaging members in the form of rotating wheels that are supported at outer ends of laterally extending support arms rigidly affixed to a transverse shaft extending below the rails of a railroad track with the door engaging members being activated automatically in response to proper orientation of the hopper car and hopper car doors in relation to the closer.

Another object of the invention is to provide a hopper car door closer in which a supporting frame supports a pair of shafts with each shaft including a pair of arms and a pair of door engaging wheels with the frame straddling the rails and being located below the rails with the door engaging wheels oriented in a retracted position out of the path of movement of the hopper car to allow the hopper car to pass over the closer with the door engaging wheels being swung upwardly to engage the hopper car doors and pivot them to a closed position when the hopper car is properly positioned with the doors properly aligned with the door engaging wheels.

A further object of the invention is to provide a hopper car door closer in accordance with the preceding objects in which the pair of shafts extend laterally to one side of the railroad track and are rotated a partial turn about a longitudinal axis by piston and cylinder assemblies extending between the frame and an offset arm on each of the shafts with the two shafts being independently actuated by a piston and cylinder assembly.

Still another object of the invention is to provide a hopper car door closer that automatically closes the doors without requiring exertion of manual force on the doors and without requiring attendant personnel by virtue of the automatic operation of the closer in response to positioning of the hopper car in relation to the closer.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
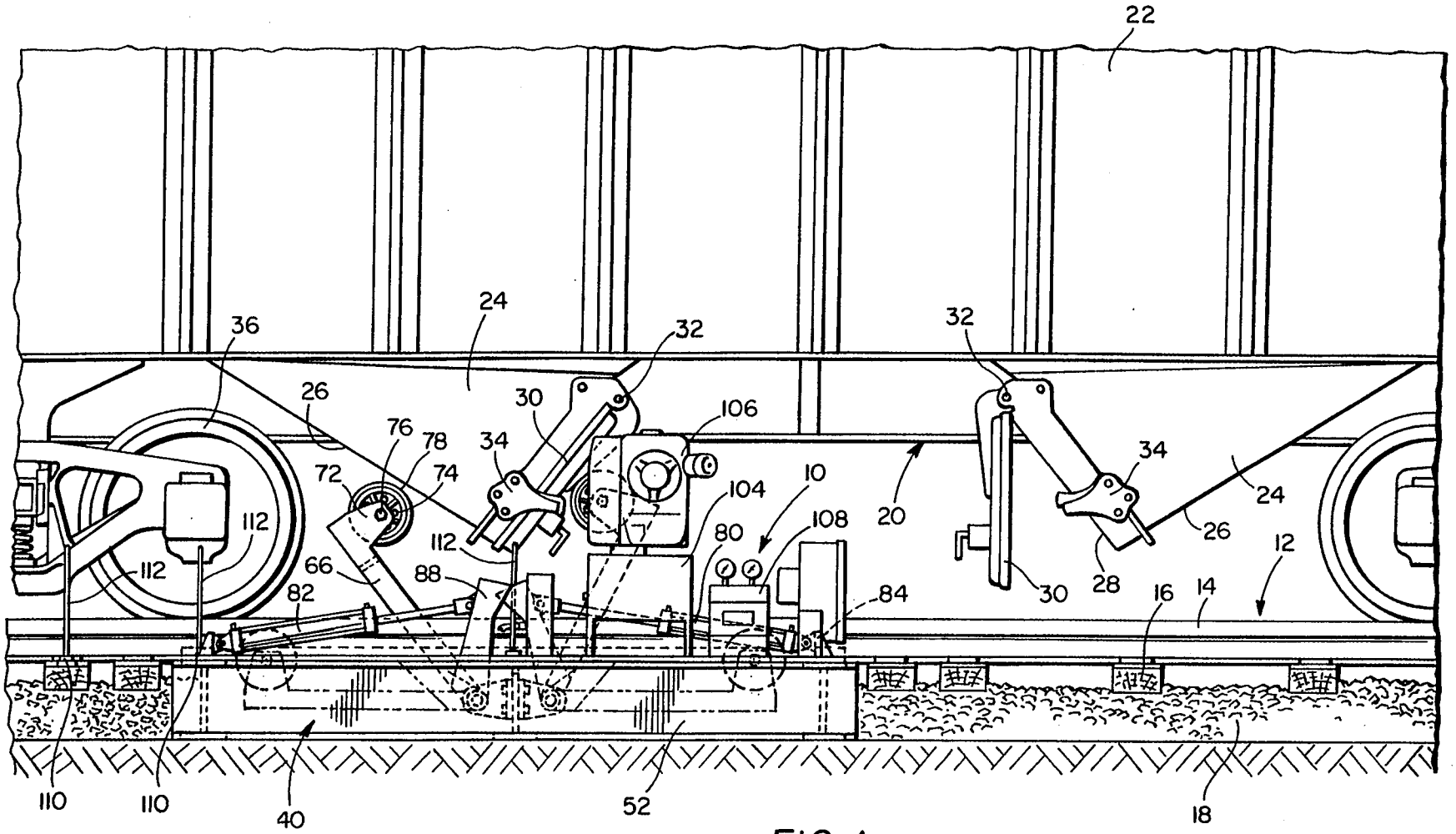
FIG. 1 is a side elevational view of the hopper car door closer of the present invention illustrating its association with the railroad track and hopper car doors.

Referring now specifically to the drawings, the hopper car door closer of the present invention is generally designated by reference numeral 10 which is associated with a railroad track generally designated by reference numeral 12 which includes parallel rails 14 supported on cross ties 16 and a supporting bed of gravel, ballast or the like 18 which represents conventional railroad track structure. The hopper car generally designated by reference numeral 20 is of conventional construction and includes the usual load carrying body 22 with downwardly extending hoppers 24 which include an inclined bottom 26 and an oppositely inclined open end 28 closed by a hopper car door 30 that is hingedly supported at its upper edge at 32 with a latch structure 34 being provided to retain the door 30 in closed position with the latch structure being releasable to enable release of the bottom edge of the hopper car door 30 for swinging from an inclined closed position to a vertically open position as illustrated in FIG. 1 for unloading the hopper car 22 all as well know in this art. After the hopper car has been unloaded, it is necessary to close the hopper car doors 30 at a location on the railroad track usually spaced some distance from the location where the hopper car was unloaded. The hopper car is moved along the railroad track on the supporting flanged wheels 36 either by a pushing or pulling engine or by gravity.

The closer 10 of the present invention moves the open, vertically hung hopper car doors 30 from their open position illustrated in the right hand portion of FIG. 1 to their closed and latched position illustrated in the left hand portion of FIG. 1 with the closer simultaneously closing the hopper car doors at opposite sides of the hopper 24. The closer operates without any modification whatsoever of the hopper car doors 30.

Figure 2:
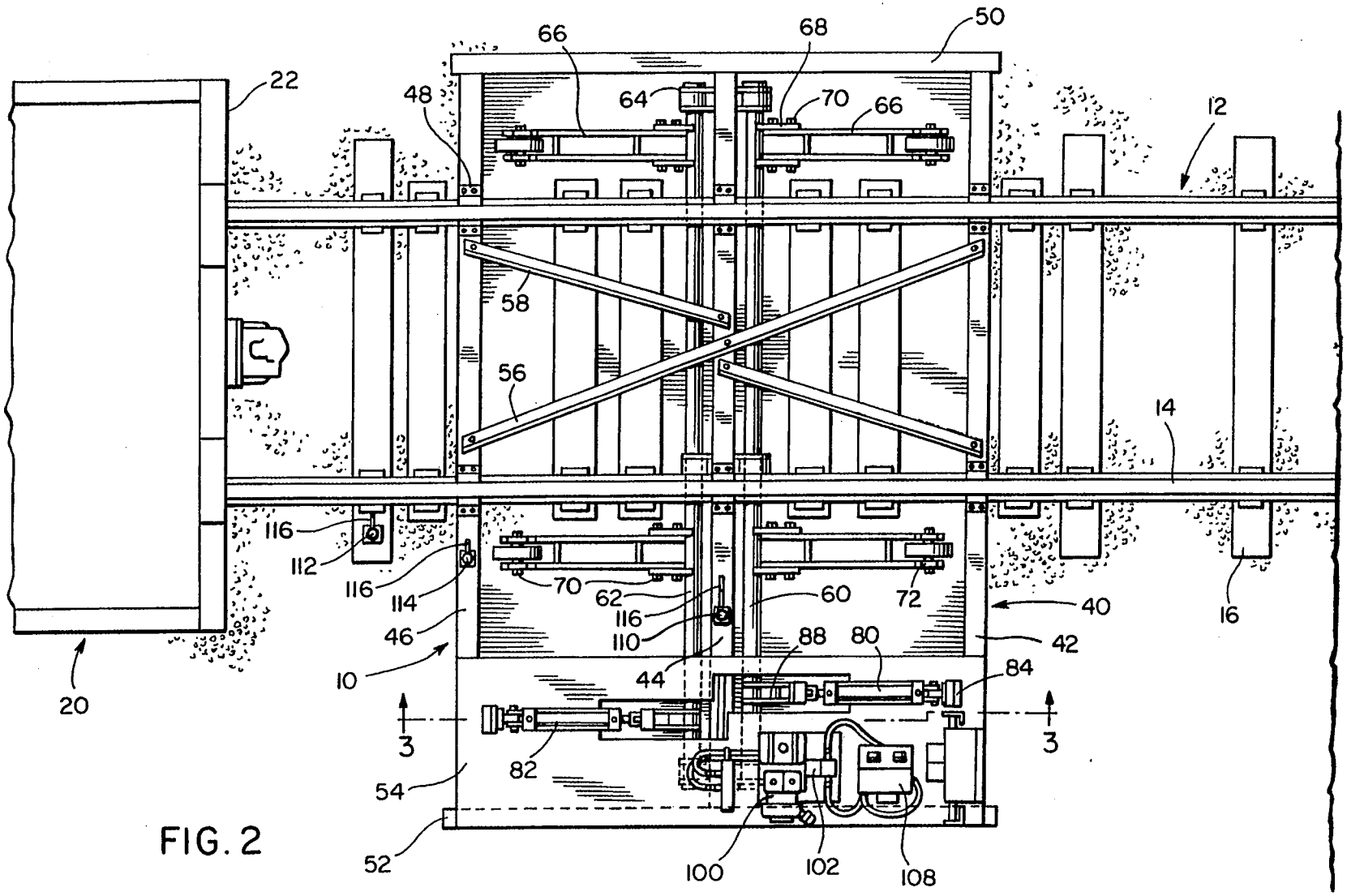
FIG. 2 is a top plan view of the structure of FIG. 1.
Figure 3:
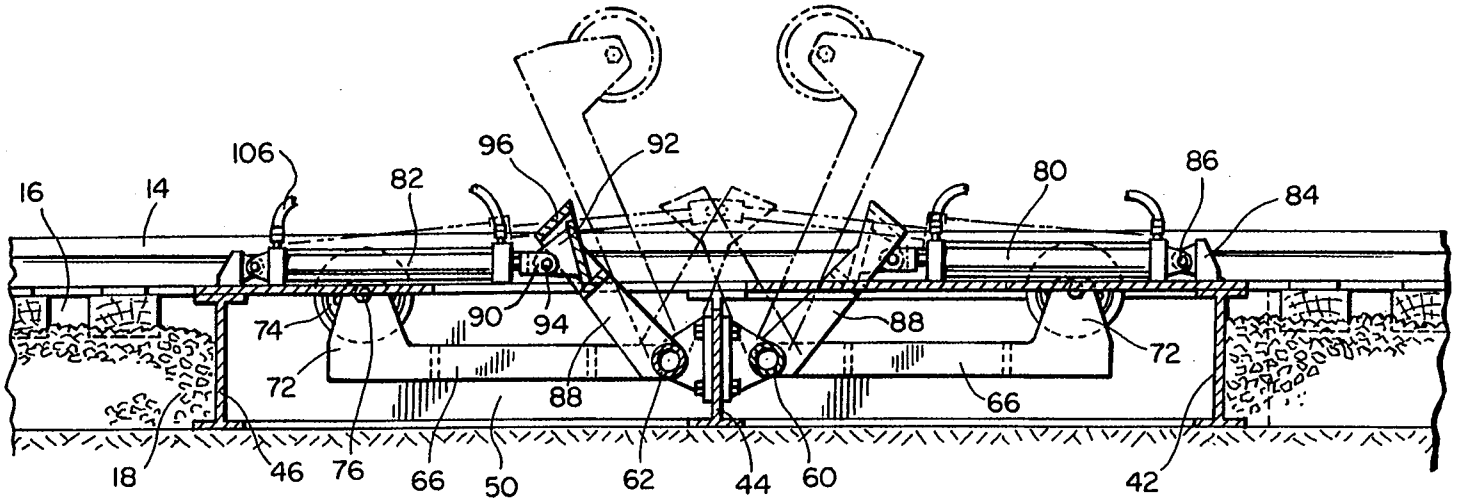
FIG. 3 is a longitudinal, sectional view taken generally along section line 3—3 on FIG. 2 illustrating the structure of the hopper car door closer and the extended position of the components illustrated in broken lines.

The closer 10 includes a rigid, generally horizontally disposed frame 40 including a plurality of parallel frame rails 42, 44 and 46 which extend under the railroad rails 14 as illustrated in the drawings with these rails being connected to the bottom flange of the rails by tie plates 48 similar to the tie plates which attach the rails to cross ties. As illustrated in FIG. 2, the frame 40 extends laterally beyond both sides of the railroad track and the frame rails are interconnected by parallel longitudinally extending frame rails 50 and 52 with the frame rail 52 being spaced more distant from the adjacent railroad rail than the frame member 50 with a supporting plate or deck 54 being mounted on a portion of the frame extending inwardly from the frame rail 52 a portion of the distance to the adjacent railroad rail 14. Also, the transverse rails 42, 44 and 46 are interconnected by diagonal brace members 56 and 58 as illustrated in FIG. 2 with the brace member 56 being continuous and the brace member 48 being discontinuous with these brace members generally defining an X-shaped reinforcement to maintain the parallelism of the transverse rails 42, 44 and 46.

Figure 4:
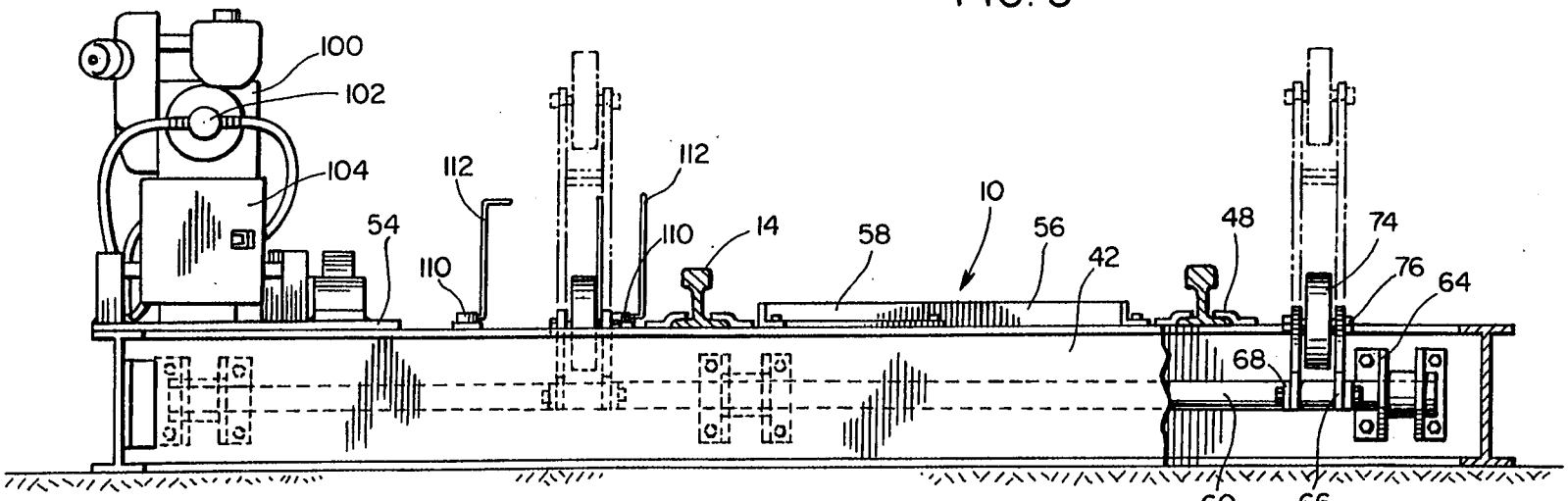
FIG. 4 is a transverse, sectional view illustrating further structural details of the closer of this invention.

A pair of parallel, transversely extending shafts 60 and 62, which may be tubular members or solid members, extend along opposite sides of the center frame member 44 and are pivotally or rotatably supported thereon by bracket type bearing structures 64 as illustrated in FIGS. 2 and 4, three supporting bracket bearing structures are provided for each of the shafts 60 and 62. Each of the shafts 60 and 62 includes a pair of laterally extending arms 66 attached to the shaft by a supporting bracket 68 with the arms 66 being rigidly attached to the bracket 68 by bolts 70. Each arm includes parallel members rigidly interconnected by bracing with the outer ends of the arms including an upturned end portion 72 rotatably journalling a wheel 74 thereon by a pivot axle or the like 76 extending between the members which form the arms 66 with the wheels 74 each including a solid rubber tire or a tire of resilient material as designated by reference numeral 78. Thus, by pivoting or rotating the shafts 60 and 62 about their longitudinal axis for a partial revolution, the arms 66 will be swung upwardly and the wheels 74 moved with the arms to bring the wheels 74 into engagement with the hopper doors 30 and pivot the hopper doors 30 to a closed and latched position without requiring the application of manual force to the hopper doors.

The mechanism for rotating or pivoting the shafts 60 and 62 is a pair of hydraulic piston and cylinder assemblies 80 and 82. Each of the piston and cylinder assemblies are pivotally connected at an outer end to a bracket 84 rigidly attached to plate 54 with a pivotal connection 86 between bracket 84 and the piston and cylinder assembly. The inner end of each of the piston and cylinder assemblies is pivotally attached to an offset laterally extending arm 88 rigidly affixed to a transverse shaft. The inner end of the piston and cylinder assembly is provided with a clevis 90 attached to a lug 92 by a pivot pin 94 which is incorporated into a rigid open frame structure 96 integral with the outer end of the arm 88. As illustrated, the piston and cylinder assemblies 80 and 82 and the arms are staggered in relation to each other so that the pivotal movement of one of the arms and shaft will not interfere with the pivotal movement of the other arm and shaft. FIG. 1 illustrates the wheels 74 in their extended, door closing position with the arms 66 upwardly inclined and the arms 88 upwardly inclined and generally oriented in a vertical position.

A drive motor 100 is mounted on the support plate 54 adjacent an outer edge thereof and drives a hydraulic pump 102 with these components being positioned on a reservoir tank 104 for hydraulic fluid with the pump supplying hydraulic pressure for operating the piston and cylinder assemblies 80 and 82 through hoses 106 in a well known manner with the hoses being connected to a control panel 108 including solenoid controlled valves connected with electrical power and being controlled by switches 110, 112 and 114 having sensing fingers 116 respectively positioned in the path of movement of certain components of the hopper car 20 so that as the hopper car reaches a particular relationship to the closer, the switches 110, 112 and 114 will be activated for activating the solenoid control valves in the control assembly 108 to actuate the piston and cylinder assemblies 80 and 82 to move the wheels 74 upwardly in an arcuate manner to engage and close the hopper car doors and enable the doors to latch in closed position after which the wheels 74 are returned to their retracted position below the surface of the rails 14.

The switch 112 is a system "on" switch which activates the system. Switch 110 is an activation switch which is actuated when the hopper car is in correct position for actuating the door lifting wheels and switch 114 is a deactivating switch allowing railcar wheel (36) or locomotive passage. When the wheels are moved to door closing position, the wheels will apply a predetermined force on the hopper doors and when a maximum prescribed system pressure is reached or a maximum distance is traveled by the closing arms and wheels, the solenoid valve in the control assembly reverses the flow of hydraulic fluid and the door closing wheels and arms return to their original position and remain there until the next hopper car comes into position and engages switch 112 and the cycle is repeated. A bypass valve can be incorporated into the hydraulic system to prevent damage to the system by excess hydraulic pressure at any point in the system thereby preventing damage to the system due to excessive hydraulic pressure.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A railroad hopper car door closer for closing oppositely swingable doors pivotally supported from a hopper car at an upper edge of the doors, said closer comprising a supporting frame adapted to underlie railroad track rails supporting the hopper car, a pair of spaced transversely extending shafts journalled from said frame and adapted to underlie the track rails, a pair of spaced, parallel laterally extending arms rigidly mounted on each of said shafts, means on an outer end of each arm to engine a hopper car door, means interconnecting the shafts and frame to pivot the shafts and swing the arms upwardly above the track rails to pivot the hopper car doors toward closed position for engaging each hopper car door with a latch on the hopper car and means controlling operation of the shaft pivoting means in response to positioning of the hopper car in a correct position for engaging the means on the arms with the hopper car doors, said means on each arm to engage the hopper car door being a rotatable wheel, said wheels adapted to engage and close hopper car doors which close in opposite directions, said means interconnecting the shafts and frame including a pair of hydraulic piston and cylinder assemblies, each of said assemblies having one end attached to said frame, an offset actuating arm attached to each of said shafts, each actuating arm being rigidly connected to a shaft at one end and pivotally connected to a hydraulic piston and cylinder assembly at the other end to enable each transverse shaft to be pivoted about the longitudinal axis of the shaft for swinging the door engaging wheels in a vertical plane to close the hopper car doors.

2. The closer as defined in claim 1 together with a hydraulic pump, tank, hoses and solenoid control valves mounted on the frame with the pump being connected to a power drive device for supplying pressurized hydraulic fluid to the piston and cylinder assemblies for pivoting said shafts.

3. The closer as defined in claim 2 wherein said means controlling movement of the door engaging members includes switches controlling said solenoid control valves to turn the system on, activate the piston and cylinder assemblies and deactivate the piston and cylinder assemblies after the hopper car doors have been closed.

4. In combination, a railroad hopper car supported on the rails of a railroad track for movement along said rails, said hopper car including at least one swingable door having an upper edge pivotally supported from the hopper car for pivotal movement about a transverse axis perpendicular to said rails, and a closing device to pivot said door to a closed position for engaging a latch to retain the door closed, said closing device including a frame positioned transversely below said railroad rails, a transversely extending shaft positioned below said railroad rails, means journalling said shaft from said frame for rotation about an axis perpendicular to said railroad rails, at least one laterally extending arm rigidly attached to said shaft and extending radially to a distal end, and means interconnecting said shaft and frame to rotate said shaft to swing said arm upwardly to engage said distal end with said hopper door and pivot said hopper door to closed, latched position.

5. The combination as defined in claim 4 wherein said arm includes wheel means on the distal end thereof for engaging the hopper car door when the arm is swung upwardly beyond said rails.

6. The combination as defined in claim 5 wherein said means interconnecting said shaft and said frame includes a fluid pressure operated ram pivotally connected to said frame and connected to said shaft in offset relation to the axis of the shaft to pivot said shaft when the ram is extended and retracted.

7. The combination as defined in claim 6 together with control means for said ram to extend the ram when the hopper car is positioned for engaging the wheel means with the hopper car door when the ram is extended.

8. The combination as defined in claim 7 wherein said frame includes a second shaft, arm, wheel means, ram and control means to close a second hopper car door when the hopper car is positioned for engaging the wheel means with the hopper car doors.

9. A hopper car door closer for doors hinged at an upper end for pivotal movement about a transverse axis perpendicular to railroad rails on which a hopper car is supported, said closer comprising a shaft extending transversely of and in underlying relation to said rails, means supporting said shaft for pivotal movement about the longitudinal axis of said shaft, laterally extending means mounted on said shaft, said laterally extending means including means at a distal end to engage and pivot said hopper car door to a closed position when said shaft is pivoted to swing said laterally extending means in a vertical plane to a position above said railroad rails to move said hopper car door engaging means into engagement with the hopper car door in spaced relation to said transverse axis at the upper end of the hopper car door, and means connected with said shaft to pivot said shaft about the longitudinal axis of said shaft.

10. The closer as defined in claim 9 wherein said hopper car door engaging means includes a wheel rotatably supported on said laterally extending means for rolling contact with said hopper car door.

11. The closer as defined in claim 10 wherein said laterally extending means includes a radially extending arm rigid with said shaft, said wheel being journalled on said arm, said wheel having a resilient peripheral tire mounted thereon.

12. The closer as defined in claim 9 wherein said means to pivot said shaft includes a fluid pressure operated power device having an output connected to said shaft in spaced relation to the longitudinal axis of said shaft for exerting rotational torque on said shaft.

13. The closer as defined in claim 10 wherein said laterally extending means includes a radially extending arm rigid with said shaft, said wheel being journalled on said arm, said wheel having a resilient peripheral tire mounted thereon, said means to pivot said shaft including a fluid pressure operated power device having an output connected to said shaft in spaced relation to the longitudinal axis of said shaft for exerting rotational torque on said shaft.

14. The closer as defined in claim 9 wherein said laterally extending means includes a pair of radially extending arms rigidly mounted on said shaft in longitudinally spaced relation, said means engaging said hopper car door including a wheel rotatably mounted on each of said arms for rolling contact with said hopper car door.

15. The closer as defined in claim 9 wherein said means supporting said shaft includes a frame extending transversely of and in underlying relation to said railroad rails, said means to pivot said shaft including a fluid pressure operated ram having one end connected to said frame, said laterally extending means mounted on said shaft including a lateral member rigid with said shaft, said ram having the other end connected to said lateral member in spaced relation to said longitudinal axis of said shaft.

16. The closer as defined in claim 15 wherein said ram includes a control valve communicating with the ram and a supply source of fluid pressure, and means responsive to positioning of the hopper car door in a predetermined relationship to said closer for actuating said valve to actuate said ram to close said hopper car door.

* * * * *